US008425751B1

(12) United States Patent
Ogozalek et al.

(10) Patent No.: US 8,425,751 B1
(45) Date of Patent: Apr. 23, 2013

(54) SYSTEMS AND METHODS FOR THE ELECTRODEPOSITION OF A NICKEL-COBALT ALLOY

(75) Inventors: Nance Jo Ogozalek, Soddy-Daisy, TN (US); Richard E. Wistrand, Tuscumbia, AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 117 days.

(21) Appl. No.: 13/020,144

(22) Filed: Feb. 3, 2011

(51) Int. Cl.
*C25D 21/14* (2006.01)
*C25D 21/16* (2006.01)

(52) U.S. Cl.
USPC ..... 205/82; 205/84; 205/101; 205/255

(58) Field of Classification Search ..... 205/82, 205/84, 101
See application file for complete search history.

(56) References Cited

U.S. PATENT DOCUMENTS 3,883,402 A * 5/1975 Malone ..... 205/50
3,963,587 A 6/1976 Kreckel
4,439,284 A * 3/1984 Walter ..... 205/96
4,648,944 A * 3/1987 George et al. ..... 205/82
5,403,460 A 4/1995 Sala et al.
5,674,370 A * 10/1997 DuPree ..... 205/67
5,985,124 A 11/1999 Yoda et al.
6,036,833 A 3/2000 Tang et al.
6,083,374 A * 7/2000 Kopp ..... 205/101
6,790,332 B2 9/2004 Ewald et al.
7,472,650 B2 1/2009 Cox et al.
2002/0112970 A1* 8/2002 Graham et al. ..... 205/781.5
2002/0164262 A1 11/2002 Engelhaupt et al.
2005/0173254 A1 8/2005 Bokisa et al.
2007/0221506 A1 9/2007 Murakami
2008/0202641 A1* 8/2008 Hilty et al. ..... 148/518
2009/0242418 A1 10/2009 Saito et al.

OTHER PUBLICATIONS

F. A. Lowenheim, Electroplating, McGraw-Hill Book Co., New York, 1978, pp. 363-377.*

* cited by examiner

*Primary Examiner* — Patrick Ryan
*Assistant Examiner* — William Leader
(74) *Attorney, Agent, or Firm* — Absolute Technology Law Group; James J. McGroary

(57) ABSTRACT

Systems and methods for electrodepositing a nickel-cobalt alloy using a rotating cylinder electrode assembly with a plating surface and an electrical contact. The assembly is placed within a plating bath and rotated while running a plating cycle. Nickel-cobalt alloy deposition is selectively controlled by controlling current density distribution and/or cobalt content in the plating bath while running the plating cycle to deposit an alloy of a desired yield strength onto the plating surface in a single plating cycle. In various embodiments, the rotating cylinder may be used as an insitu monitoring method to assist in obtaining the properties desired.

12 Claims, 7 Drawing Sheets

Comparison of Yield Strength versus Cobalt Content in Solution for Rotating Cylinder Specimens Comparison of Yield Strength versus Cobalt Content in Deposit for Rotating Cylinder Specimens Comparison of Yield Strength versus Cobalt Content in Deposit for Rotating Cylinder Specimens and 72-Hour Tensile Specimens Comparison of Yield Strength versus Cobalt Content in Solution for Rotating Cylinder Specimens Comparison of Yield Strength versus Percent Strain for Rotating Cylinder Specimens Comparison of Cobalt in Deposit versus Percent Strain of Tensile Specimens for Rotating Cylinder Specimens

SYSTEMS AND METHODS FOR THE ELECTRODEPOSITION OF A NICKEL-COBALT ALLOY

FEDERAL RESEARCH STATEMENT

The invention described herein was made in the performance of work under a NASA contract and by an employee of the United States Government and is subject to the provisions of Section 305 of the National Aeronautics and Space Act of 1958, as amended, Public Law 85-568 (72 Stat. 435, 42 U.S.C. §2457), and may be manufactured and used by or for the Government for governmental purposes without the payment of any royalties thereon or therefore.

BACKGROUND OF THE INVENTION

Electroplating is primarily used for depositing a layer of material to bestow a desired property (e.g., abrasion and wear resistance, corrosion protection, lubricity, aesthetic qualities) to a surface that otherwise lacks that property. Another application uses electroplating to build up thickness on undersized parts. The process used in electroplating is called electrodeposition.

Nickel is a silver-white metal that is electrodeposited onto surfaces in a variety of industries including the electronics, electroforming, and automotive markets. Bright nickel is mainly used for its decorative value because it offers a smooth and mirror bright finish. A drawback to bright nickel is that the brighter the deposit gets, the less ductile it becomes.

For example, one component of the space shuttle main engine is plated with nickel. Removal of impurities from the metal nickel plating chips in recent years (e.g., with the use of nickel purifiers (removes cobalt), water purifiers) is believed to be responsible for reduced strength in electrodeposited nickel.

When electrodeposition of nickel from a typical nickel sulfamate plating solution is done over many days and while plating large parts, deposited nickel with reduced mechanical properties may be deposited. As a result, plating must typically be terminated and the part removed until the plating solution is reconditioned. These interruptions create additional problems when plating resumes by requiring exacting surface preparation procedures to ensure the subsequent nickel layers bond adequately. In addition, each additional plating cycle increases fabrication time and production costs. Therefore, it is desirable to reduce the number of plating runs, thereby resulting in cost savings and a better part with fewer bondlines.

The introduction of cobalt into the deposition of nickel to increase strength is known in the art. Conventional systems and methods typically use cobalt levels greater than 10%. However, a deposit containing 10% cobalt is too brittle for structural applications and results in a part that is not readily weldable. Conventional systems typically utilize cobalt concentrations greater than 1% as well as utilize other metals and/or organic additives in the plating solution. The concentration of cobalt utilized may be product or application specific and/or may be specified by the customer. For example, a customer may specify the alloy content and the plating company would adjust its plating tank accordingly.

The need remains to provide a simple and cost-efficient nickel sulfamate plating system that does not require brighteners, unusual additives, or other metal constituents to electrodeposit a nickel-cobalt alloy with increased tensile strength and low sulfur content. The low sulfur content allows the alloy to be welded increasing the number of potential usages.

SUMMARY OF THE INVENTION

Systems and methods are provided for electrodeposition plating to co-deposit cobalt with nickel at levels below 8% from a nickel sulfamate solution to generate an alloy with increased yield strength that retains sufficient strain and maintains weldability.

A plating tank is equipped with two pumps, a heater controlled by a temperature controller and a thermistor probe, a titanium basket for containing metallic nickel, and a titanium basket for containing metallic cobalt. A filter cartridge and a filter are used on the respective immersion pumps. The nickel basket is covered with a double layer polypropylene bag while the cobalt basket is enclosed in a single layer cotton bag. Current is applied and monitored with multimeters. The exact configuration of the plating tank and equipment used may vary depending on the size of the part to be plated. For example, several titanium baskets and a pump recirculation system may be utilized.

To electrodeposit a nickel-cobalt alloy onto a plating surface, an electrolytic nickel sulfamate solution at a certain concentration is added to the plating tank creating a liquid plating bath. Nickel metal is added to the nickel basket and a measured amount of cobalt metal or a cobalt sulfamate solution is added to the cobalt basket. The baskets are submerged in the liquid and are normally kept full. A rotating cylinder electrode assembly with a plating surface is placed into the plating bath and the assembly is rotating during a plating cycle. The nickel-cobalt alloy is electrodeposited onto the plating surface during the plating cycle. The measured amount of cobalt in the plating bath is selectively controlled and maintained to achieve the desired yield strength for a single plating cycle. To obtain a finer control of low cobalt concentrations in the deposit, cobalt is added to the plating tank using a liquid cobalt sulfamate solution; cobalt metal may also be used to obtain higher cobalt concentrations.

In the embodiment shown, the rotating cylinder is not required for the electrodeposition of the alloy onto a part but rather serves as an insitu method for monitoring the mechanical properties of the alloy during the plating operation. The rotating cylinder is removed during the plating operation; the deposit is then removed and subsequently analyzed for its mechanical and chemical properties. The rotating cylinder is beneficial during long plating cycles because it does not require that the plated part be removed during the plating operation. In addition, a plated part does not have to be sacrificed to determine the properties of the deposited alloy.

The current applied to the plating system (i.e., to each titanium basket) and the concentration of cobalt in solution determines the concentration of cobalt co-deposited with nickel. A nickel sulfamate plating tank is typically operated with a current of 20 amps per square foot (asf). Nineteen asf may be applied to the nickel basket and 1 asf to the cobalt basket or 20 asf to the nickel basket (i.e., if no cobalt metal is placed in the cobalt basket). The cobalt concentration in the plating solution is the primary factor in determining the amount of cobalt co-deposited.

It is desirable to enhance the tensile strength of the deposit with low level co-deposition of cobalt.

It is desirable to provide an extended plating cycle and maintain yield strength above 36 ksi.

It is desirable to provide a deposit with increased cobalt concentration without a similar increase in sulfur concentration.

It is further desirable to provide a deposit that can be welded.

GLOSSARY

As used herein, the term "yield strength" refers to the stress at which elastic deformation changes to plastic deformation and a predetermined amount of permanent deformation occurs.

As used herein, the term "percent strain" refers to the geometrical measure of deformation expressed as a percentage that represents the relative displacement between particles in the material body.

As used herein, the term "electroplating" refers to a process that uses electrical current to coat an object with a thin layer of material, such as a metal.

As used herein, the term "weldability" refers to the joinability or ability of a material to be welded.

As used herein, the term "rotating cylinder" or "rotating cylinder electrode assembly" refers to a circular rod with a flat end adapted to turn or revolve around an axis or center point and which has a plating surface suitable for electrodeposition.

As used herein, the term "plating cycle" refers to an electrodeposition period timed on amp-hours.

As used herein, the term "amp-hour" refers to the integration of current over time.

As used herein, the term "plating bath" refers to an electrolytic solution capable of electrodeposition of an alloy onto a plating material.

As used herein, the term "plating surface" refers to a substrate for receiving an adherent metallic deposit by electrodeposition.

As used herein, the term "plating tank" refers to a receptacle, container, or structure for holding a plating bath.

As used herein, the term "current density" refers to the amperage of the electroplating current divided by the surface area of the part.

As used herein, the term "alloy" refers to a partial or complete solid solution of one or more elements in a metallic matrix.

DETAILED DESCRIPTION

Figure 1:
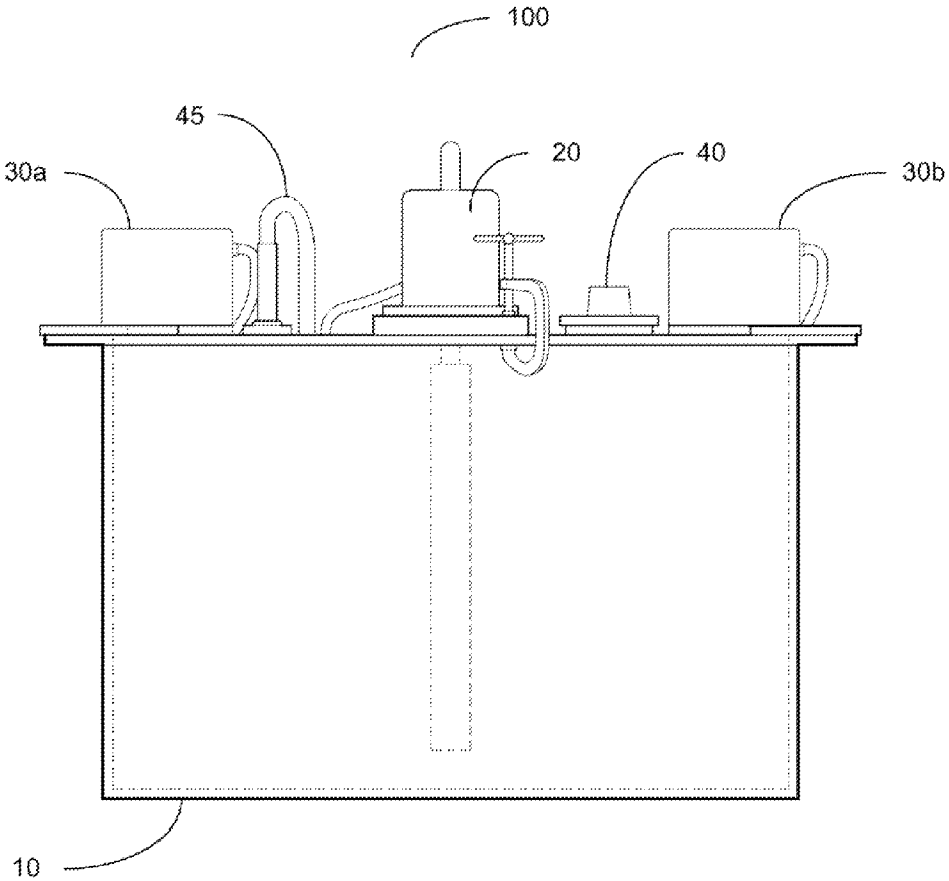
FIG. 1 is a side view of an exemplary embodiment of a system for the electrodeposition of a nickel-cobalt alloy with the rotating cylinder shown.

For the purpose of promoting an understanding of the present invention, references are made in the text to exemplary embodiments of systems and methods for the electrodeposition of a nickel-cobalt alloy, only some of which are described herein. It should be understood that no limitations on the scope of the invention are intended by describing these exemplary embodiments. One of ordinary skill in the art will readily appreciate that alternate but functionally equivalent materials, components, and placement may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change to the basic function to which it is related.

Figure 2:
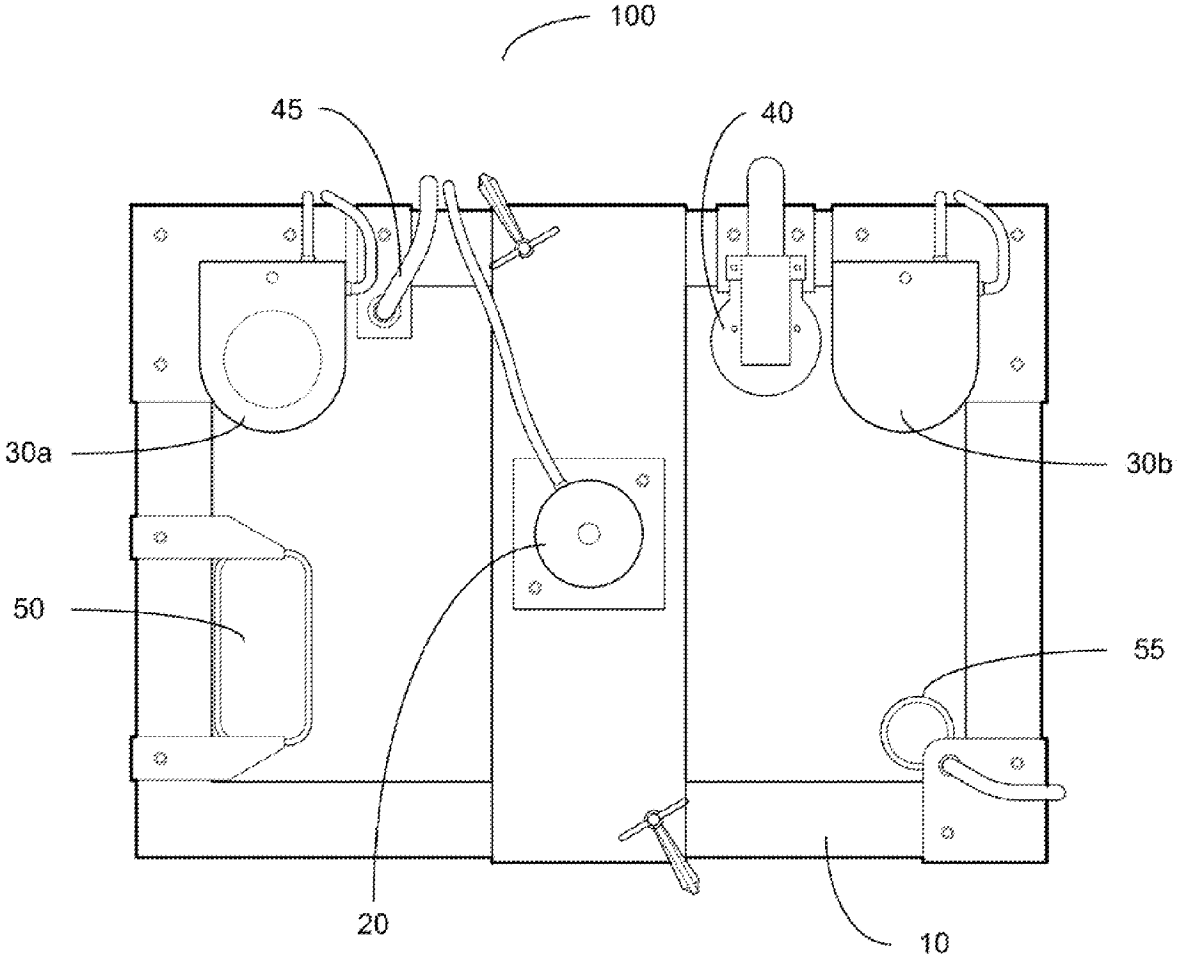
FIG. 2 is a top view of an exemplary embodiment of a system for the electrodeposition of a nickel-cobalt alloy with the rotating cylinder shown.

FIGS. 1 and 2 illustrate an exemplary embodiment of electroplating system 100 for the electrodeposition of a nickel-cobalt alloy. Electroplating system 100 and related methods provide a plating technique to co-deposit cobalt with nickel from a nickel sulfamate solution at levels sufficient to extend plating cycles while maintaining required mechanical properties. The alloy obtained has yield strength greater than 36 ksi in a single plating cycle while retaining sufficient strain. The alloy also has a sulfur content at or below 6 parts per million, thereby retaining weldability.

Conventional plating tanks use a nominal electrolytic nickel sulfamate solution (with a trace amount of cobalt, less than 0.06%) and typically result in deposited nickel samples with yield strength from 36-41 ksi. However, as previously noted, plating must typically be terminated and the part removed while the plating solution is reconditioned. These extended plating cycles require exacting surface preparation procedures to ensure the subsequent nickel layers bond adequately. As a result, each additional plating cycle increases fabrication time and production costs.

In the embodiment shown, plating tank 10 is operated with a solution temperature of 120 F and the cumulative current density is maintained at 20 amps per square foot (asf). The solution constituents are maintained at 72 grams/liter (g/L) nickel, 37 g/L boric acid, and 0.2 g/L dodecyl sulfate. The solution pH is maintained between 3.8 and 4.2 standard units with periodic additions of sulfamic acid or nickel carbonate as required. Solution specific density remains between 1.238 and 1.264 units.

Plating tank 10 (e.g., a 35-liter polypropylene tank 12"l×18"w×12"d) is equipped with two pumps 30*a* and 30*b* (e.g., Custom Masters Lab Series), heater 40 (e.g., Clepco stainless) controlled by a temperature controller (e.g., Barnant Model 89000-10) and thermistor probe 45 (e.g., YSI), rectangular titanium basket 50 (e.g., 4"×2"×11" l) containing metallic nickel, and round titanium basket 55 (e.g., 1.5" OD×8" l) containing metallic cobalt. A filter cartridge (e.g., Custom Masters Flo King 5 micron poly-spun) and a filter (e.g., 10 micron "Mini Magnum") are used on the respective immersion pumps. The nickel basket is covered with a double layer polypropylene bag while the cobalt basket is enclosed in a single layer cotton bag. Current is applied, e.g., with Kepco power supplies, and monitored with multimeters.

It is to be understood that the components and/or set-up of plating tank 10 and operating conditions may be varied to suit a desired application. One of skill in the art will readily appreciate that solution temperature, current density, tank size, pump number and size, source and form of metal, etc., may all be varied to accommodate an infinite variety of applications.

In various embodiments, specimens for mechanical properties testing may be created insitu by plating onto a rotating cylinder electrode or rod assembly (rotating cylinder specimens) or by suspending a shadow box in the plating solution and plating the deposit on a stainless steel sheet (tensile specimens).

In the embodiment shown in FIGS. 1 and 2, plating tank 10 includes rotating cylinder electrode or rod assembly 20, e.g., a 1.12" diameter stainless steel (300 series) rod rotated at approximately 240 rpm using a laboratory type stirrer. The stainless steel surface is polished smooth to an almost mirror finish. The rotating cylinder electrode or rod assembly 20 has a plating surface and an electrical contact point suitable for electrodeposition and the nickel-cobalt deposit is plated directly onto its surface.

A deposit area (e.g., 3"×3.5") may be sectioned off with the remaining area of the rod masked with platers tape. A thin strip of platers tape is placed vertically along the rod so the deposit is not continuous and allows the deposit to be removed from the rod. Deposition duration may be controlled by selecting a desired plating cycle so as to selectively produce a deposit of a desired thickness (e.g., 2.0 hours to create a deposit 0.0019" to 0.0021" thick). For example, at 20 asf, the nominal plating rate for a nickel sulfamate bath is 1 mil/hour or 0.001 inch per hour.

The stirrer and rod assembly 20 may be mounted to a polypropylene platform. The platform may be bolted to the tank flange to ensure the rod remains in the center of the tank to provide consistency between samples. This arrangement is utilized when there is not another part in the tank being plated. If a part or other object (e.g., the 72-hour tensile specimen shadow box) is in the tank, then the rotating cylinder location will be adjusted so that all objects have clear line-of-sight to the titanium baskets and the solution is flowing freely across the plating surfaces.

Although variation may have limited affect on deposit properties, it is desirable to maintain stable rotation rates between samples.

Sample strips may be obtained from the deposit removed from the rod. For example, 5 strips 0.5" wide may be obtained and the center three specimens cut manually into "dogbone" shaped specimens for tensile testing per ASTM E8 by using two metal plates secured with bolts to form the "dogbone" shaped template. Any extra width of deposit remains with the end two strips. The edges of the "dogbones" are manually lightly sanded (e.g., with 600 grip paper).

The rotating cylinder specimens must be heat treated, e.g., at 650° F. +/−5° F. in argon for 1 hour +/−1 minute. The temperature, time, and placement in the oven are critical to obtaining specimens with consistent properties. The specimens may then be mechanically tested per ASTM E8 at room temperature for ultimate and yield strength.

The heat treatment process is critical to providing consistent and reproducible mechanical properties. Sample placement in the oven as well as ramp rates and heating durations may be selected to optimize and provide consistent and reproducible results. The furnace temperature, heating zone, and heating duration must be maintained within strict limits.

If desired, thicker tensile specimens for mechanical testing may also be prepared. In one embodiment, a square shadow box (e.g., 4.69" by 4.25") is suspended in the solution and the deposit plated onto a stainless steel sheet (e.g., for a plating duration of 72 hours). "Dogbone" tensile specimens were machined by EDM from the center region of the deposit, heat treated, and tested as described for the 0.002" specimens above. Since the square shadow box method resulted in a deposit with nodule buildup around the perimeter, an alternate method was developed.

In a second embodiment, tensile specimens were prepared by taping a polyvinyl chloride (PVC) pipe with a 6" diameter to a stainless steel sheet. The interface between the PVC pipe and the stainless sheet is sealed with a liquid maskant material compatible with the nickel sulfamate solution. The center opening of the PVC pipe is the plating surface. The quantity of nodule buildup was significantly less when utilizing the PVC pipe. Plating duration may be varied to optimize deposition (e.g., 72 hours). For plating cycles with long durations (i.e., thicker deposits), the 72-hour tensile specimen will yield more accurate tensile properties. Also, many testing companies may not be able to test 0.002" specimens.

Adding a measured amount of cobalt to the plating tank with the addition of a measured amount of cobalt sulfamate liquid concentrate significantly increases cobalt in the alloy deposit and yield strength.

There is a close correlation between the deposit yield strength, deposit cobalt concentration, and the solution cobalt concentration. The hardness of the alloy deposit (measured by Rockwell C) increases as the cobalt concentration increases. Therefore, the alloy's mechanical properties can be enhanced with the co-deposition of low levels of cobalt with nickel from a nominal nickel sulfamate plating solution. In addition, this strength can be maintained over time.

The Rockwell C values for specimens plated in a small round PVC shadow box were on average between 21.5 and 27.5. These specimens were plated for 24 hours and contained 1.46 and 3.69% cobalt content in the deposit respectively. The cobalt sulfamate solution concentration was approximately 110 and 227 ppm respectively.

The two parameters that may be varied to selectively control nickel-cobalt alloy deposition are (1) the current density distribution between the nickel and cobalt anodes (e.g., 19 asf Ni and 1 asf Co, 19.85 asf Ni and 0.15 asf Co, 20 asf Ni) and (2) the cobalt content in the solution.

Chemical analysis of low cobalt levels in plating systems by normal analytical techniques often results in inconsistent results due to interference from the high nickel content and boric acid. Analytical methods utilized include Inductively Coupled Plasma (ICP), ICP-Mass Spectrometer, X-Ray Fluorescence (XRF), and Atomic Absorption Spectrophotometer (AA). Results by AA are typically the most consistent. XRF results compare with those obtained by AA, but are very dependent on instrumentation operating parameters.

Cobalt concentrations may be further increased by the addition of cobalt metal, e.g., by adding cobalt metal to the round titanium basket. However, if the cobalt metal remains submerged in the nickel sulfamate solution without any electrolytic plating in progress, the cobalt metal will dissolve naturally and may increase the cobalt concentration in the solution to a greater than desired level. In various embodiments, cobalt sulfamate solution may be added to the plating tank periodically instead of adding cobalt metal to the titanium basket.

The systems and methods may be used to enhance the mechanical properties of the deposited alloy obtained during electrolytic nickel plating from a nickel sulfamate plating solution with the addition of a small amount of cobalt sulfamate concentrate to the plating bath. More consistent results may be obtained if the cobalt sulfamate is incrementally added in liquid form to maintain the level of cobalt in the plating bath between 100 and 130 parts per million. This concentration yields cobalt in the deposit between 1.5% and 2%. The resulting metallic alloy has a significantly higher tensile strength, approximately 20 to 30%, without significantly reducing the ductility of the plating.

Cobalt metal and cobalt sulfamate solution are more expensive than the nickel metal and nickel sulfamate solution respectively. Therefore, the higher the cobalt in the deposit, the more expensive the plating. In addition, when the cobalt content reaches a certain amount, the deposit will become very brittle. If the deposit cracks, the corrosion protection is compromised.

The concentration of cobalt desired would be application specific and depends on the customer's parts and what properties are required for these parts to withstand the environment they will be used in.

The deposit sulfur content does not increase as the cobalt concentration increases, thereby retaining the weldability of the alloy. In one exemplary embodiment, the plating solution is conditioned between each plating cycle to assist in removing any sulfur that may have built up in the solution. Conditioning may involve plating on a flat or corrugated stainless steel sheet at various current densities for different time intervals.

A more consistent alloy is obtained by maintaining the concentration of cobalt in solution with periodic and/or metered additions of liquid cobalt sulfamate solution instead of utilizing the more typical cobalt metal anode method. The liquid cobalt sulfamate is added to maintain the cobalt concentration at the required level to obtain the alloy with desired tensile properties.

To maintain a low concentration of cobalt in the deposit, the cobalt metal may have to be removed from the plating tank between plating cycles; otherwise, the cobalt metal continues to dissolve increasing the cobalt content in the solution.

The system and method utilizes a rod assembly 20 to co-deposit the alloy from which the tensile strength and sulfur content of the resulting alloy is determined. The rod assembly 20 is used to monitor the plating bath electrodeposition process that is independent of the part or component being plated in the bath at the same time. The rod assembly 20 is an in-situ quality control method used to monitor the plating process of varying durations, from hours to days.

The system and method are applicable to any commercially plated nickel electrolytic process which requires an enhanced tensile strength without sacrificing its ductility or weldability.

The rotating cylinder method is applicable to any electrolytic plating process on which the mechanical properties of the deposit are desired.

Figure 3:
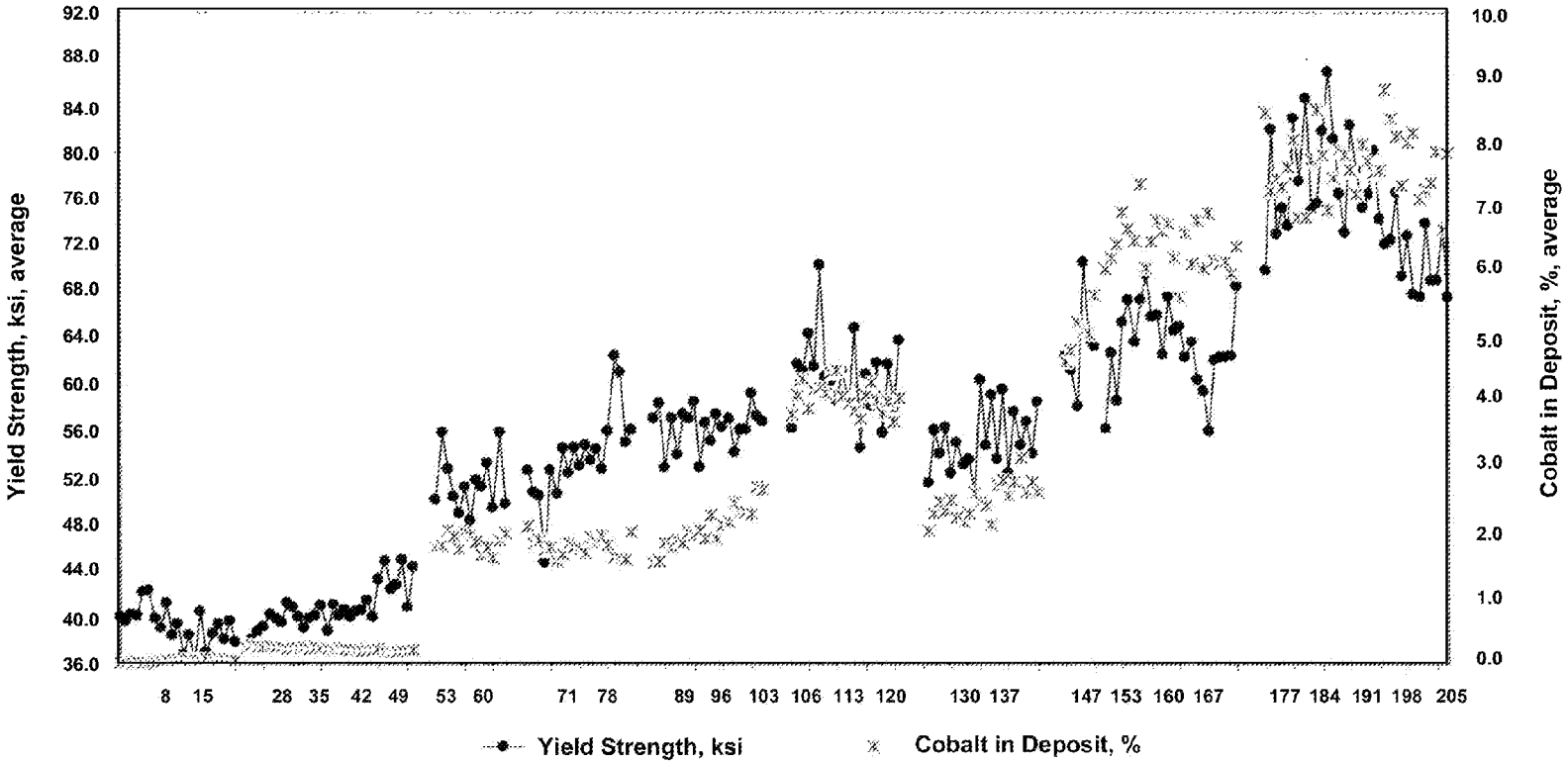
FIG. 3 shows a comparison of yield strength versus cobalt content in deposit for the rotating cylinder specimens.

FIG. 3 shows a comparison of yield strength versus cobalt content in the deposit for the rotating cylinder specimens. The purpose of the experiment was to maintain a deposit with a yield strength greater than 36 ksi over long plating cycles. The desired mechanical properties were achieved with a cobalt concentration of 0.5 to 1.5% in the deposit.

For thick deposits (i.e., greater than 0.025" or 25 hours plating time), it is recommended that a 1.0 to 1.75% cobalt content in the deposit is maintained to ensure the desired yield strength.

Figure 4:
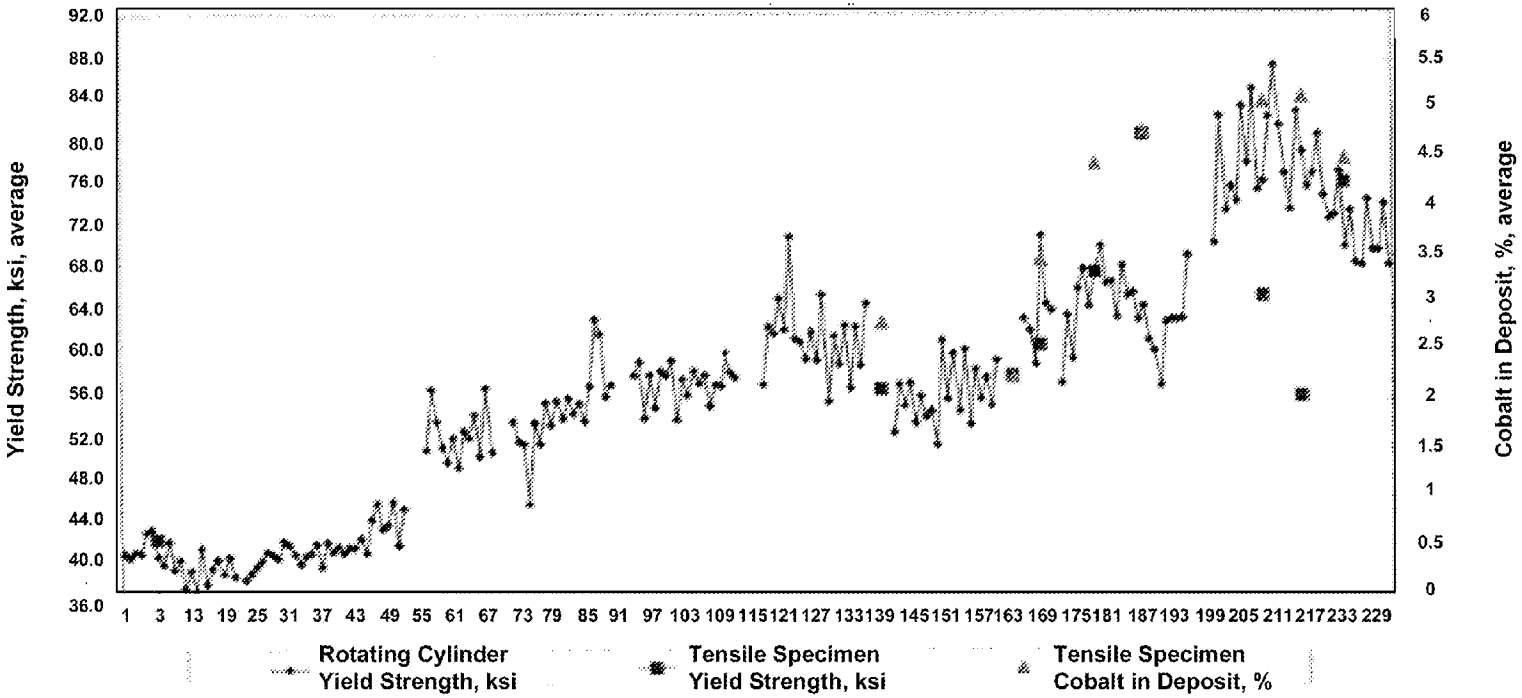
FIG. 4 shows a comparison of the rotating cylinder specimens and the 72-hour tensile specimens versus cobalt content in deposit.

FIG. 4 shows a comparison of the rotating cylinder specimens and the 72-hour tensile specimens versus cobalt content in deposit. The 72-hour tensile specimens had a yield strength of approximately 42 ksi with a 1% cobalt content in deposit.

Figure 5:
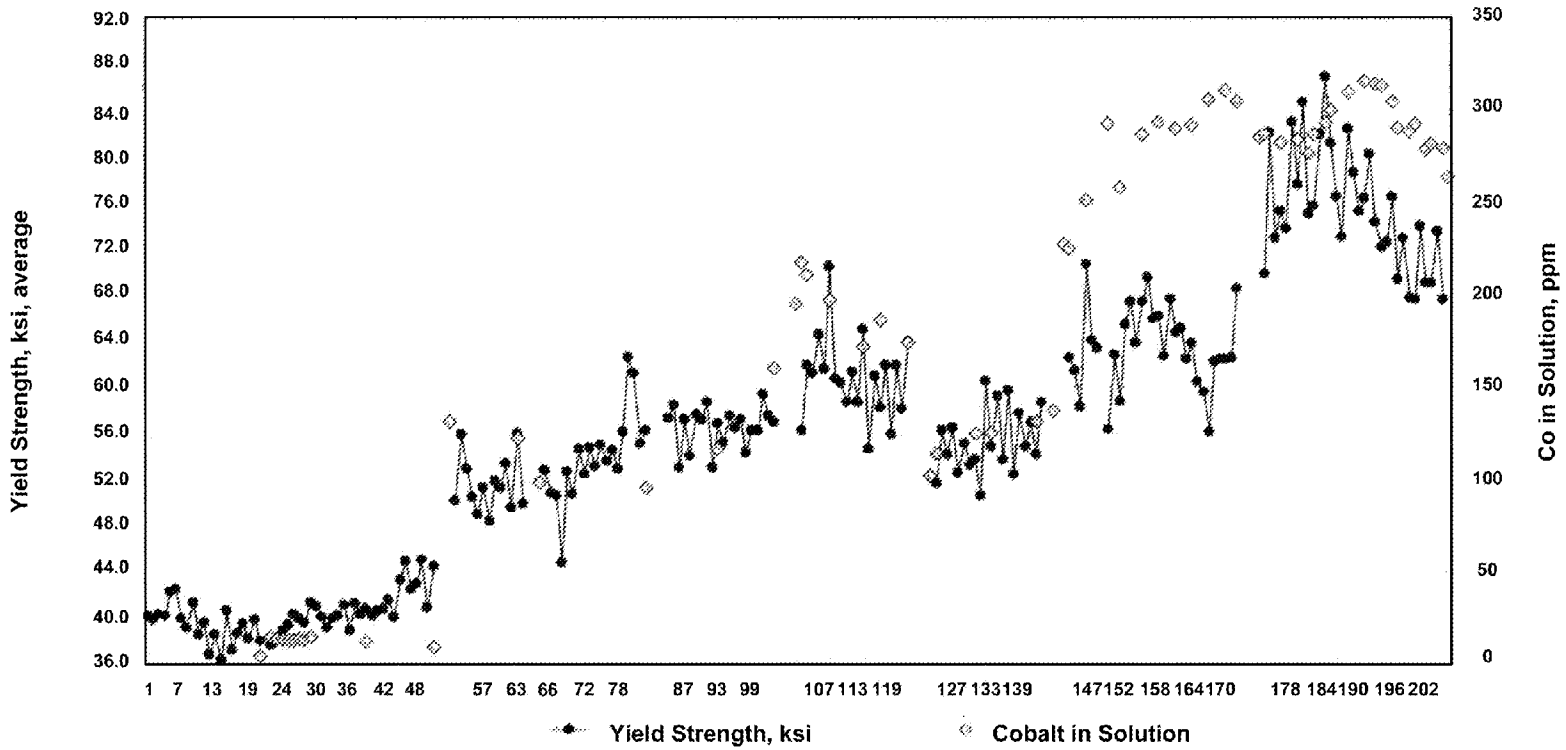
FIG. 5 shows a comparison of yield strength versus cobalt content in solution for the rotating cylinder specimens.

FIG. 5 shows a comparison of yield strength versus cobalt content in solution for the rotating cylinder specimens. For 0.5 to 1.5% cobalt content in deposit, the optimal cobalt concentration in the plating solution is estimated to be approximately 20 to 35 ppm.

Figure 6:
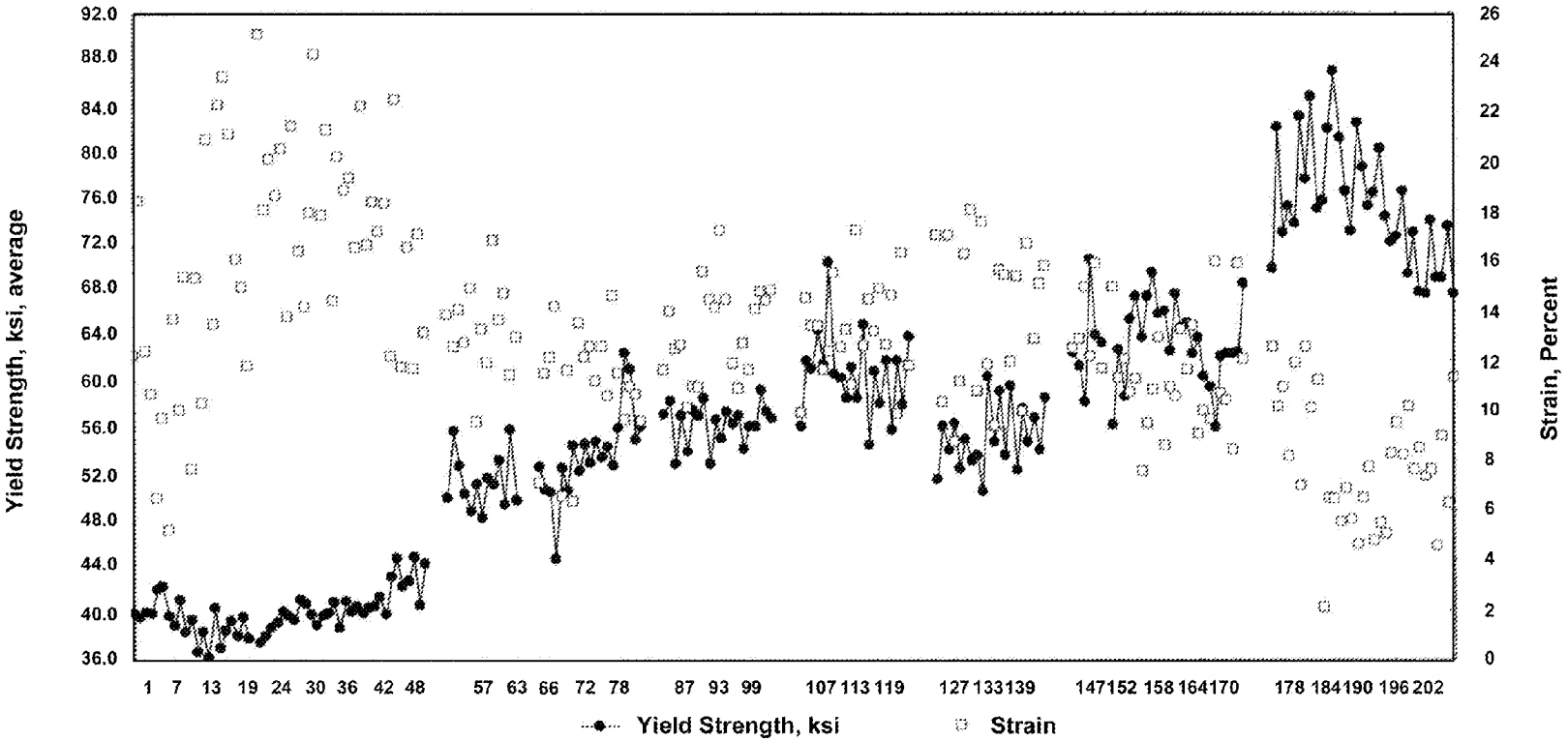
FIG. 6 shows a comparison of yield strength versus percent strain for the rotating cylinder specimens.

FIG. 6 shows a comparison of yield strength versus percent strain for the rotating cylinder specimens.

Figure 7:
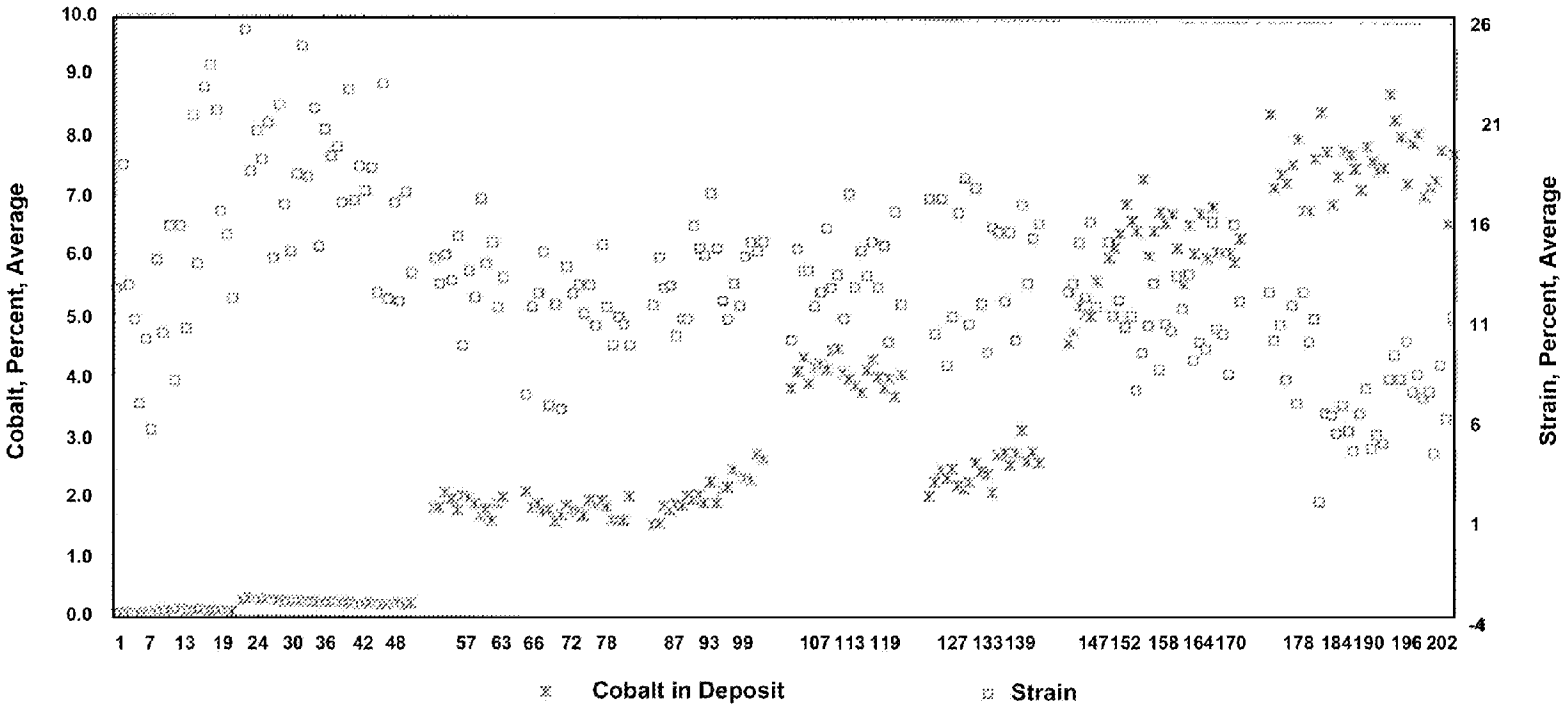
FIG. 7 shows a comparison of cobalt in deposit versus percent strain for the rotating cylinder specimens.

FIG. 7 shows a comparison of cobalt in deposit versus percent strain for the rotating cylinder specimens.

What is claimed is:

1. A method of electrodeposition of a nickel-cobalt alloy having a target yield strength comprising the steps of:

providing an electrolytic nickel sulfamate solution in a plating tank;

adding a measured amount of cobalt to said nickel sulfamate solution to provide a nickel-cobalt alloy plating bath;

establishing a correlation between the yield strength of an electrodeposited nickel-cobalt alloy and the concentration of cobalt in the plating bath;

selecting a target yield strength value above 36 KSI;

placing a part to be plated into the plating bath;

placing a rotating cylinder electrode assembly with a plating surface into said plating bath for in situ creation of a test specimen;

selecting a desired plating cycle duration to selectively produce a deposit of a desired thickness on the part;

electrodepositing a nickel-cobalt alloy from the plating bath onto the part while simultaneously rotating the rotating cylinder electrode and electrodepositing a nickel-cobalt alloy onto said plating surface of the rotating cylinder electrode;

while continuing to electrodeposit nickel-cobalt alloy onto the part, removing a portion of the nickel-cobalt alloy deposited on the plating surface of the rotating cylinder electrode and creating a test specimen;

heat treating said test specimen;

mechanically testing said test specimen at room temperature to determine a yield strength value;

comparing the yield strength value of the test specimen to the target yield strength value to determine the necessary cobalt concentration in said plating bath; and selectively controlling and maintaining the concentration of cobalt in said plating bath during said plating cycle so that the nickel-cobalt alloy electrodeposited onto the part has the target yield strength after running said plating cycle.

2. The method of claim 1 wherein the amount of cobalt in said plating bath is maintained between 20 and 35 parts per million.

3. The method of claim 1 wherein said nickel-cobalt alloy has a cobalt concentration of at least 1.5 parts per million.

4. The method of claim 1 wherein an amount of cobalt is provided to the plating bath by cobalt metal.

5. The method of claim 1 wherein a subsequent plating cycle follows said plating cycle and which further includes removing an amount of cobalt from said plating bath between plating cycles.

6. The method of claim 1 wherein an amount of cobalt is provided to the plating bath by cobalt sulfamate.

7. The method of claim 6 wherein said cobalt sulfamate is incrementally added in liquid form to maintain said measured amount of cobalt within a given range in said plating bath during said plating cycle.

8. The method of claim 7 wherein said given range is between 20 and 35 ppm parts per million cobalt.

9. The method of claim 1 which further comprises selectively controlling current density distribution during said plating cycle by distributing current to a first basket containing nickel metal and a second basket containing cobalt metal.

10. The method of claim 9 wherein 19 asf is applied to said first basket and 1 asf is applied to said second basket.

11. The method of claim 9 wherein 19.85 asf is applied to said first basket and 0.15 asf is applied to said second basket.

12. The method of claim 9 wherein said second basket is empty and 20 asf is applied to said first basket.

* * * * *